US007535426B2

(12) United States Patent
Burnham et al.

(10) Patent No.: US 7,535,426 B2
(45) Date of Patent: May 19, 2009

(54) INTEGRATED ANTENNA IN DISPLAY OR LIGHTBOX

(75) Inventors: Robert J. Burnham, Novi, MI (US); Gregory R. Hamel, Livonia, MI (US); Paul A. DeVries, Wayne, MI (US); Jadranko Soc, Ann Arbor, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 369 days.

(21) Appl. No.: 11/156,406

(22) Filed: Jun. 20, 2005

(65) Prior Publication Data

US 2006/0285345 A1 Dec. 21, 2006

(51) Int. Cl.
*H01Q 1/32* (2006.01)

(52) U.S. Cl. ..... 343/711; 343/712

(58) Field of Classification Search ..... 343/711–713, 343/700 MS; 725/75

See application file for complete search history.

(56) References Cited

U.S. PATENT DOCUMENTS

| | | | | |
|---|---|---|---|---|
| 6,100,850 | A | 8/2000 | Utsumi | |
| 6,508,877 | B2 | 1/2003 | Meisen | |
| 6,509,877 | B2 | 1/2003 | Masaki | |
| 6,529,749 | B1 | 3/2003 | Hayes et al. | |
| 6,556,812 | B1 | 4/2003 | Pennanen et al. | |
| 6,646,610 | B2 | 11/2003 | Troelsen | |
| 6,670,925 | B2 | 12/2003 | Iwai et al. | |
| 6,683,578 | B2 | 1/2004 | Nishikido et al. | |
| 6,700,540 | B2 | 3/2004 | Holshouser | |
| 6,724,348 | B2 | 4/2004 | Fang | |
| 6,809,689 | B1 | 10/2004 | Chen | |
| 6,980,154 | B2 * | 12/2005 | Vance et al. | 343/700 MS |
| 7,202,826 | B2 * | 4/2007 | Grant et al. | 343/713 |
| 7,358,904 | B2 * | 4/2008 | Prassmayer et al. | 343/702 |
| 2002/0061775 | A1 | 5/2002 | Iwai et al. | |
| 2003/0129950 | A1 | 7/2003 | Kwak | |
| 2004/0104855 | A1 | 6/2004 | Nomiyama et al. | |
| 2004/0109286 | A1 | 6/2004 | Shin | |
| 2004/0116157 | A1 | 6/2004 | Vance et al. | |
| 2004/0140935 | A1 | 7/2004 | Korva | |
| 2004/0145451 | A1 | 7/2004 | Failing | |
| 2004/0196179 | A1 | 10/2004 | Turnbull | |
| 2004/0202001 | A1 * | 10/2004 | Roberts et al. | 362/494 |
| 2004/0252061 | A1 | 12/2004 | Vance | |
| 2004/0252191 | A1 * | 12/2004 | Davis et al. | 348/148 |
| 2004/0264119 | A1 | 12/2004 | Hirota | |
| 2005/0024268 | A1 | 2/2005 | McKinzie, III et al. | |
| 2005/0024271 | A1 | 2/2005 | Ying et al. | |
| 2005/0024278 | A1 | 2/2005 | Amemiya et al. | |
| 2005/0270432 | A1 * | 12/2005 | Overline | 349/16 |

* cited by examiner

*Primary Examiner*—Shih-Chao Chen
*Assistant Examiner*—Marlon Browne
(74) *Attorney, Agent, or Firm*—Brinks Hofer Gilson & Lione

(57) ABSTRACT

An automobile head unit display system including an antenna, a lightbox assembly and a circuit board is described therein. The antenna is attached to the lightbox system, while the lightbox assembly is attached to the circuit board. The antenna and the lightbox assembly are in communication with the circuit board.

16 Claims, 3 Drawing Sheets

INTEGRATED ANTENNA IN DISPLAY OR LIGHTBOX

BACKGROUND OF THE INVENTION

1. Field of the Invention

The present invention generally relates to automobile head units and more particularly to automobile head units capable of receiving one or more wireless protocols.

2. Description of the Known Technology

There are a growing number of devices, such as cellular phones, that use one or more wireless protocols to communicate with other devices. One common wireless protocol is Bluetooth™. Bluetooth™ is a wireless short-range communication protocol for data and voice between both mobile and stationary devices.

Automobile manufacturers are currently discovering new uses for Bluetooth and other wireless protocols for automobiles. One such use is to synchronize a Bluetooth™ enabled cellular-phone with the entertainment system of the automobile. The entertainment system of the automobile may be a radio, CD player, DVD player, automobile navigation unit or any device or combination of devices which provide information or entertainment to an occupant of an automobile. For example, when a Bluetooth™-enabled cellular phone receives an incoming call, the entertainment system of the automobile may be able to lower the volume of the radio and display the caller ID of the incoming caller on a head unit of the entertainment system. The head unit has a display which traditionally would display the radio station or the track number of a CD.

However, in order for the entertainment system of the automobile to synchronize with a Bluetooth™ enabled device, an antenna for receiving the Bluetooth™ signal is to in communication with the entertainment system. Thus, the antenna to be placed such that the antenna has adequate reception of the Bluetooth enabled device.

BRIEF SUMMARY OF THE INVENTION

In overcoming the drawbacks and limitations of the known technology, an automobile head unit display system is disclosed. The automobile head unit display system includes an antenna, a lightbox assembly and a first circuit board. The antenna is attached to the lightbox system, while the lightbox assembly is attached to the first circuit board. The antenna and the lightbox assembly are in communication with the first circuit board.

The lightbox assembly has a lightbox, a display attached to the lightbox and a bracket for attaching the display to lightbox. Typically, the lightbox is constructed of a non-conductive material and the display is a liquid crystal display. To provide backlighting for the display, the first circuit board has one or more light sources, usually light emitting diodes.

The antenna has a receiving area and a feed in communication with the receiving area. Preferably, the antenna is a planar inverted f-antenna. The receiving area is configured to face the occupant compartment of the automobile for preferred data reception and is configured to receive at least one of the following wireless communications signal protocols: IEEE 802.11a, IEEE 802.11b, IEEE 802.11g, IEEE 802.11x, HomeRF™ or Bluetooth™.

Further objects, features and advantages of this invention will become readily apparent to those persons skilled in the art after a review of the following description, with reference to the drawings and claims that are appended to and form part of this specification.

DETAILED DESCRIPTION OF THE INVENTION

Figure 1:
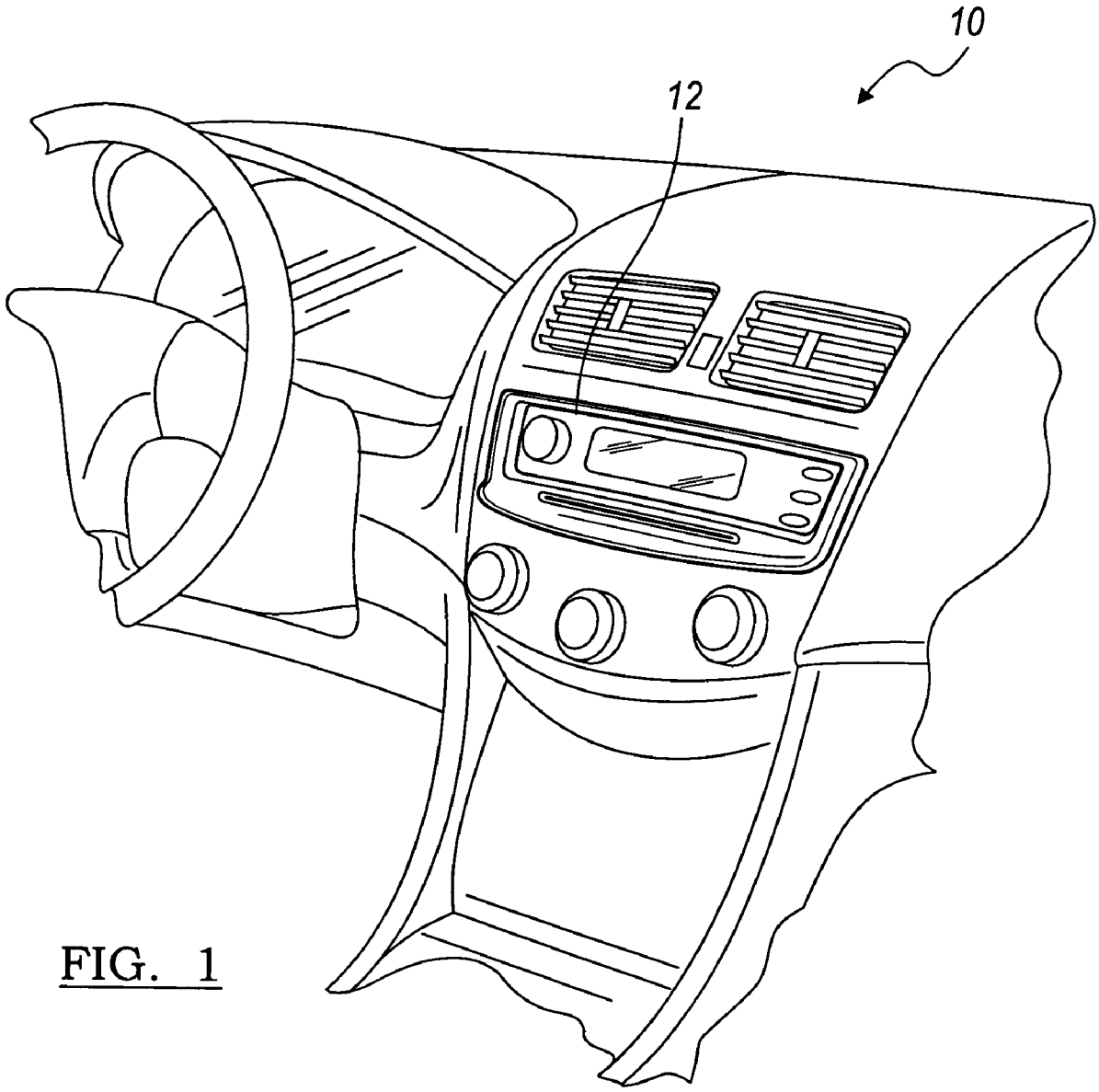
FIG. 1 is a perspective view of a occupant compartment of an automobile having an automobile head unit display system in accordance with one embodiment of the present invention.

FIG. 1 illustrates an occupant compartment of an automobile. As shown, the compartment 10 includes an automobile head unit display system 12 in accordance with one embodiment of the present invention.

Figure 2:
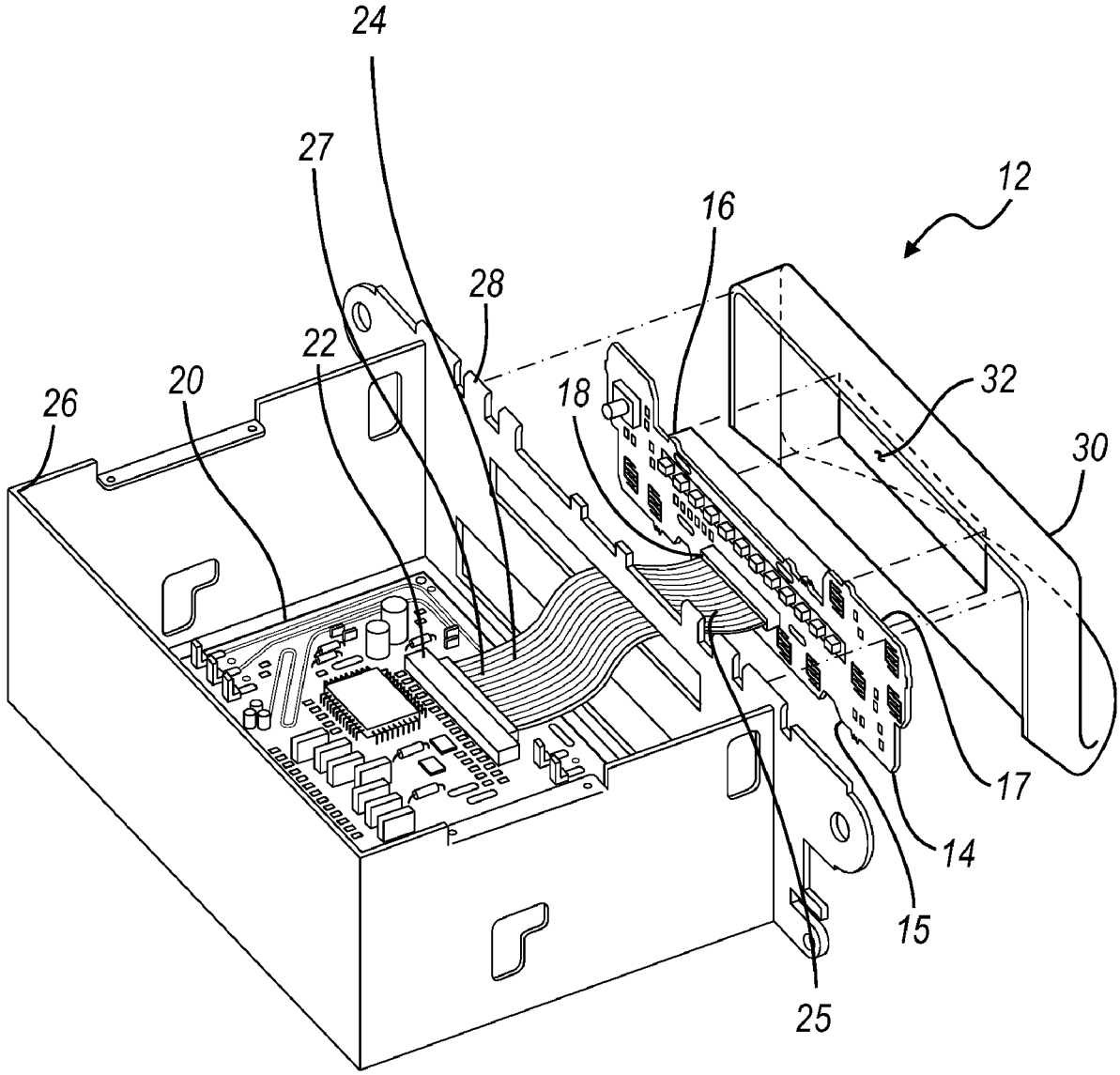
FIG. 2 is a perspective view of the automobile head unit display shown in FIG. 1.

As shown in FIG. 2, the automobile head unit display system 12 preferably includes a daughterboard 14 having a back 15 and a front 17. Attached to the front 17 of the daughterboard 14 is a lightbox assembly 16. As will be described below and shown in FIG. 5, the lightbox assembly 16 is in communication with the daughterboard 14 and is preferably attached to the daughterboard 14 through the use of one or more clips. The daughterboard 14 also includes a first connector port 18.

The automobile head unit display system 12 may also include a motherboard 20 having a second connector port 22. In this embodiment, a cable 24 is provided to electrically connect the daughterboard 14 to the motherboard 20. Preferably, the cable 24 has first and second ends 25, 27. The first end 25 connects to the first connector port 18 and the second end 27 connects to the second connector port 22 to electrically connect the daughterboard 14 and the motherboard 20 for data transmission.

Preferably, the motherboard 20 will be disposed within an electrically shielded housing 26 to prevent electromagnetic interference from interfering with the motherboard 20 or other components of the system 12. The housing 26 includes a daughterboard support member 28. When fully assembled, the daughterboard 14 is supported and held in place by the daughterboard support member 28 and a bezel 30 having a viewing area 32. The bezel 30 covers the daughterboard 14 and is attached to the housing 26 such that the viewing area 32 of the bezel 30 will allow an occupant of the automobile to view the lightbox assembly 16 through the viewing area 32.

Figure 3:
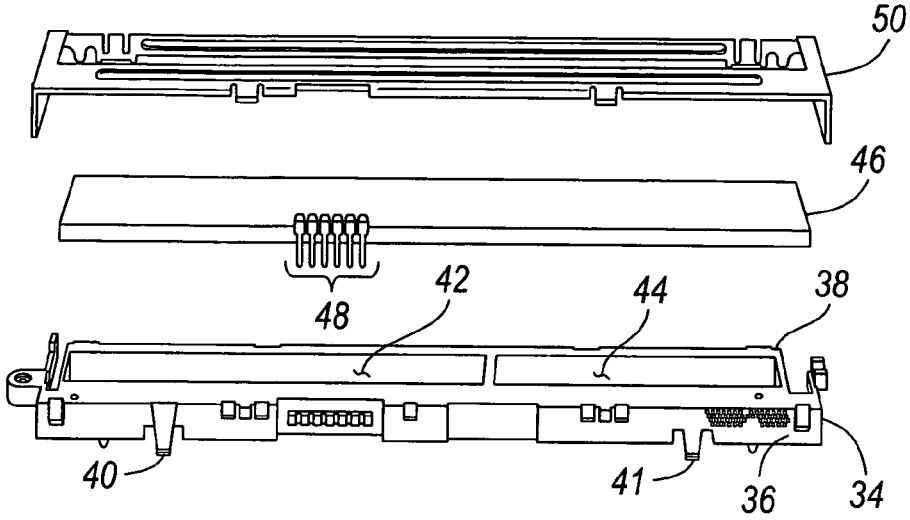
FIG. 3 is an exploded view of a lightbox assembly in accordance with one embodiment of the present invention.

Referring now to FIG. 3, in this embodiment, the lightbox assembly 16 generally includes a lightbox 34, a display 46 and a bracket 50 retaining the display 46 to the lightbox 34. Preferably, the lightbox 34 is made of a non-conductive material such as plastic, and has an inner side 36 and an outer side 38 opposite the inner side 36. The inner side 36 of the lightbox 34 includes retaining clips 40, 41 extending therefrom for retaining the lightbox assembly 16 to the front 17 of the daughterboard 14 as will be further described in a later paragraph.

Two channels 42 and 44 are formed through the lightbox 34 from the inner side 36 to the outer side 38. However, any number of channels may be formed. The display 46 is placed on the top side 38 of the lightbox 34. Preferably, the display 46 is a liquid crystal display. Extending from the display 46 are a plurality of display pins 48. Preferably, the bracket 50 retains the display 46 to the lightbox 34 through the use of an adhesive or by frictional engagement.

Figure 4:
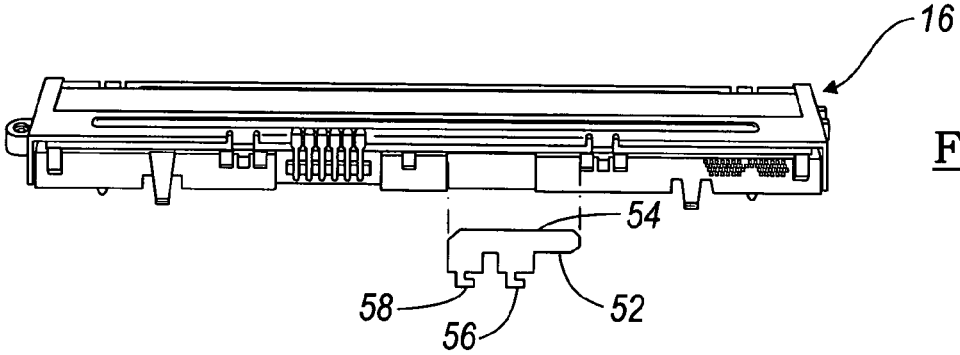
FIG. 4 is a side view of an antenna attached to the lightbox assembly in accordance with one embodiment of the present invention.

Referring now to FIG. 4, an antenna 52 attaches to one of the sides of the lightbox assembly 34. Preferably, the antenna 52 is attached to the lightbox assembly 34 by any suitable means e.g. by using adhesive, fasteners, or the antenna 52 may be attached the lightbox assembly 16 by molding the lightbox 34 around the antenna 52.

In this embodiment, the antenna 52 has a receiving area 54 in communication with a feed pin 56 and a ground pin 58. Preferably, the antenna of 52 is a planar inverted f-antenna, capable of receiving one or more wireless signal protocols such as IEEE 802.11a, IEEE 802.11b, IEEE 802.11g, IEEE 802.11x, HomeRF™ and Bluetooth™. By having the antenna 52 attached to the lightbox assembly 16 as described above, the receiving area 54 will face the occupant compartment of the automobile, placing the antenna 52 in a position for preferred data reception.

Figure 5:
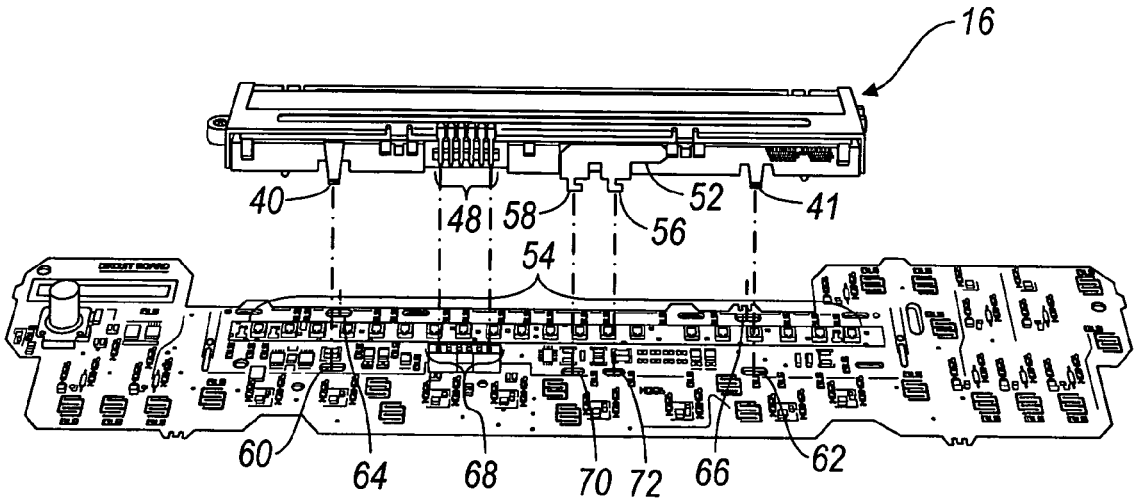
FIG. 5 is an exploded top view of a daughterboard and the lightbox assembly in accordance with one embodiment of the present invention.

Referring now to FIG. 5, the front 17 of the daughterboard 14 and the lightbox assembly 16 with the antenna 52 attached thereto is shown. The front 17 of the daughterboard 14 has one or more light sources 54. Preferably, the light sources 54 are light emitting diodes. When the lightbox assembly 16 is attached to the daughterboard 14, the light sources 54 provide light, which passes through the channels 42, 44 (as shown in FIG. 3), to backlight the display 46.

The front 17 of the daughterboard 14 has a number of through holes 60, 62, 64, 66. The though holes extend through the depth of the daughterboard 28. The retaining clips 40, 41 as well as additional clips on the lightbox 34 are placed through the through holes 60, 62, 64, 66 and attach the lightbox assembly 16 to the daughterboard 14.

The daughterboard 14 also includes a display port 68. When the lightbox assembly 16 is attached to the daughterboard 14, the communication lines 48 of the display 46 extend to the display port 68, such that the display pins 48 are electrically connected to the display port 66, placing the display 46 in communication with the daughterboard 14.

The daughterboard 14 also includes a feed port 70 and a ground port 72. When the lightbox assembly 16 attached to the daughterboard 14 the feed pin 56 and the ground pin 58 will extend through the feed port 70 and the ground port 72 respectively. This places the antenna 52 in communication with the daughterboard 14.

As a person skilled in the art will readily appreciate, the above description is meant as an illustration of implementation of the principles this invention. This description is not intended to limit the scope or application of this invention in that the invention is susceptible to modification, variation and change, without departing from the spirit of this invention, as defined in the following claims.

The invention claimed is:

1. An automobile headunit display system comprising:

an antenna having a plurality of antenna connection pins, the lengths of the plurality of antenna connection pins defining a first set of axes;

a lightbox assembly to which the antenna is fixedly attached, the lightbox assembly having a plurality of lightbox assembly pins, the lengths of the plurality of lightbox assembly pins defining a second set of axes;

a circuit board to which the lightbox assembly is attached, the lightbox assembly and the antenna being in electrical communication with the circuit board; and the first set of axes being substantially parallel to the second set of axes.

2. The system of claim 1, wherein the antenna has a receiving area and a feed in communication with the receiving area, the receiving area configured to face an occupant compartment of the automobile for preferred data reception.

3. The system of claim 1, wherein the antenna is a planar inverted f-antenna.

4. The system of claim 1, wherein the antenna is configured to receive at least one of the wireless communication signal protocols: IEEE 802.11a, IEEE 802.11b, IEEE 802.11g, and IEEE 802.11x.

5. The system of claim 1, wherein the lightbox assembly further comprises a lightbox, a display attached to the lightbox, and a bracket configured to attach the display to the lightbox.

6. The system of claim 5, wherein the lightbox is comprised of a non-conductive material.

7. The system of claim 5, wherein the display is a liquid crystal display.

8. The system of claim 5, wherein the circuit board further comprises a light source configured to provide backlighting for the display.

9. The system of claim 8, wherein the light source is at least one light emitting diode.

10. The system of claim 1, wherein the circuit board includes a first circuit board and a second circuit board in communication with the first circuit board, the second circuit board being configured to receive a signal from the antenna and output a signal to the lightbox assembly.

11. An automobile headunit display assembly comprising:

a planar inverted f-antenna receiving area and a feed in communication with the receiving area, the receiving area configured to face an occupant compartment of the automobile for preferred data reception, a feed area having a plurality of antenna connection pins, the lengths of the plurality of connection pins defining a first set of axes;

a lightbox assembly having a lightbox, a display and a bracket configured to fixedly attach the display to the lightbox, wherein the planar inverted f-antenna is fixedly attached to the lightbox, the lightbox assembly having a plurality of lightbox assembly pins, the lengths of the lightbox assembly pins defining a second set of axes;

a circuit board to which the lightbox assembly is attached, the lightbox assembly and the antenna being in electrical communication with the circuit board;

a light source configured to provide back lighting for the display; and the first set of axes being substantially parallel to the second set of axes.

12. The system of claim 11, wherein the antenna is configured to receive at least one of the wireless communication signal protocols: IEEE 802.11a, IEEE 802.11b, IEEE 802.11g, and IEEE 802.11x.

13. The system of claim 11, wherein the lightbox is constructed of a non-conductive material.

14. The system of claim 11, wherein the display is a liquid crystal display.

15. The system of claim 11, wherein the light source is at least one light emitting diode.

16. The system of claim 11, wherein the circuit board includes a first circuit board and a second circuit board in communication with the first circuit board, the second circuit board being configured to receive a signal from the planar inverted f-antenna and output a signal to the lightbox assembly.

* * * * *